United States Patent [19]

Kanno et al.

[11] Patent Number: 4,779,086

[45] Date of Patent: Oct. 18, 1988

[54] LIQUID CRYSTAL DEVICE AND METHOD OF DRIVING SAME

[75] Inventors: Hideo Kanno, Kawasaki; Shinichi Yamashita, Atsugi; Atsushi Mizutome, Kanagawa; Hiroshi Inoue, Yokohama, all of Japan

[73] Assignee: Canon Kabushiki Kaisha, Tokyo, Japan

[21] Appl. No.: 901,826

[22] Filed: Aug. 29, 1986

[30] Foreign Application Priority Data

Sep. 5, 1985 [JP] Japan ..... 60-194803

[51] Int. Cl.[4] ..... G09G 3/00

[52] U.S. Cl. ..... 340/805; 340/784; 340/789

[58] Field of Search ..... 340/784, 765, 805, 789

[56] References Cited

U.S. PATENT DOCUMENTS 4,476,466 10/1984 Mitani et al. ..... 340/805
4,649,383 3/1987 Takeda ..... 340/784
4,660,030 4/1987 Maezawa ..... 340/784
4,724,433 2/1988 Inoue et al. ..... 340/805

*Primary Examiner*—Howard A. Birmiel
*Attorney, Agent, or Firm*—Fitzpatrick, Cella, Harper & Scinto

[57] ABSTRACT

In a method of driving a liquid crystal panel using one horizontal period (1H) as a reversal period, the liquid crystal panel using a TFT as a switching element for driving the panel in units of divided blocks and comprising the block division TFT's (B-TFT), a matrix circuit for driving each block in time division, and a TFT active matrix panel; each block of the B-TFT's is further divided into two half-blocks and a control signal shifted in phase between adjacent two half-blocks is applied to time-divisionally drive the liquid crystal panel at superposed timings. High intensity lines produced at the intersection of blocks due to the charge sharing effect are eliminated to thereby enable a high quality image to be produced.

8 Claims, 4 Drawing Sheets

LIQUID CRYSTAL DEVICE AND METHOD OF DRIVING SAME

BACKGROUND OF THE INVENTION

1. Field of the Invention

The present invention relates to a liquid crystal device and a method of driving the same, and more particularly to a liquid crystal device and a method of driving the same capable of suppressing high intensity lines produced while driving the device in units of blocks by using TFT's (thin film transistors) as switching elements.

2 Related Background Art

As shown in FIG. 3, in a conventional method of driving a liquid crystal panel having a TFT active matrix circuit, internal video signal lines of a display panel 1 are divided into a plurality of blocks. A matrix circuit 2 is provided for matrix-connection between the internal video signal lines of each block and external video signal lines having the same number of lines as the former lines. Sample/hold switching elements constructed of a B-TFT (block dividing TFT) array 3 are interposed on the respective internal video lines between the matrix circuit 2 and the display panel 1. Control signals are supplied to the switching elements of each block to drive the display panel in time division using one horizontal period (lH) as a reversal period.

FIG. 4 shows a detailed connection diagram of FIG. 3, wherein external video signal lines Dl, D2, . . . , Dm are divided into m internal video signal lines Sl, S2, . . . , Sm per one block by the matrix circuit 2. In case of k blocks, the total number of video signal lines is m×k. Each of the internal video signal lines Sl, S2, . . . , Sm is grounded via a hold capacitor 10. Switching elements 11 interposed between the capacitor and the matrix circuit are driven in time division by respective block division gate drivers Bl, B2, . . . , Bk to output video signals to pixels.

When a liquid crystal panel constructed as above is driven using one horizontal period (lH) as a reversal period, a charge shift phenomenon of a so-called charge sharing effect occurs at the intersection between divided blocks, e.g., between lines Sm and Sl of FIG. 4, due to the capacitance between source lines of B-TFT's. As a result, ΔV is superposed on the video signal of line Sm so that a video signal having a larger voltage amplitude than the original video signal is outputted (with opposing electrode 12 being grounded).

FIG. 5 illustrates the principle of the charge sharing effect, and FIG. 6 is a timing chart showing the charge sharing effect. In FIG. 5, a central broken line indicates the intersection between blocks, the block at the left of the line being called block 1 and that at the right being called block 2. The last signal line Sm of block 1 is driven by the output signal from the last source line Dm and the drive voltage Bl for the block division TFT's of block 1. The first signal line Sl of block 2 is driven by the output signal from the first source line Dl and the drive voltage B2 for the block division TFT's of block 2, source line capacitance Cm and Cl as seen from source terminal side of the block division TFT's, correspond to the video signal hold capacitor C. Interline capacitance Css producing ΔV appears between the source lines. Referring now to FIG. 6, when a gate pulse is applied to line Bl, a video signal on line Dm is transferred to line Sm via the B-TFT to charge the source line capacitor Cm. After charging the source lines of block 1 to which the capacitor Cm belongs is completed, another gate pulse is applied to line B2 to thereby charge the source lines including line Sl of block 2. In this case, the charging waveforms on lines Sm and Sl at the intersection between the two blocks change as shown in FIG. 6. Particularly, ΔV shown by oblique lines is superposed on line Sm and its video signal becomes larger in amplitude than its original, while the video signal on line Sl changes at the start of reversal as shown by oblique lines. Such phenomenon results from the charge sharing effect of the source interline capacitance Css between the capacitors Cm and Cl. The relationship between ΔV and V is approximately defined by the following formula:

$$\Delta V \approx Css/(C+Css)\cdot V(v)$$
$$(C=Cm\approx Cl)$$

If a liquid crystal display panel as above is driven without any correction, the last lines Sm of the blocks are highly brightened so that it is quite unsuitable for a display device.

SUMMARY OF THE INVENTION

The present invention seeks to solve the above problems and provide a liquid crystal device and method of driving the same wherein high intensity lines of blocks produced by the charge sharing effect during lH reversal driving are suppressed thereby realizing a high quality image.

In order to solve the above problems, the present invention provides a method of driving a liquid crystal device wherein internal video signal lines of a TFT active matrix panel are divided into a plurality of blocks, a matrix circuit is provided for matrix-connection between the internal video signal lines of each block and external video signal line having the same number of lines as the former lines, sample/hold switching elements are interposed on the (respective internal video lines between the matrix circuit and the panel, and control signals are supplied to the switching elements of each block to drive the panel in time division using one horizontal period as a reversal period; a method of driving a liquid crystal device wherein the switching elements of each block are further divided into two half-blocks, a switching signal line is provided for each of the half-blocks, the phase of a control signal applied to the switching elements for each of the half-blocks is shifted between adjacent half-blocks to output video signals onto the internal video signal lines at superposed timings.

DESCRIPTION OF THE PREFERRED EMBODIMENTS

Figure 5:
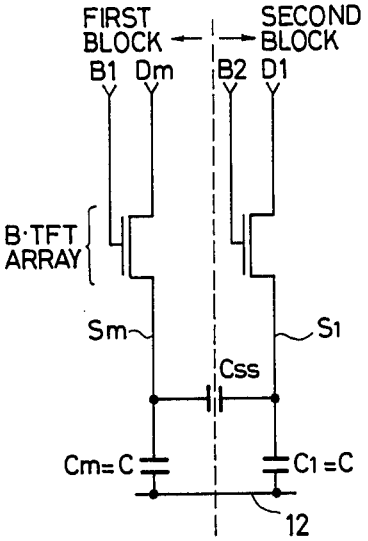
FIG. 5 is an equivalent circuit illustrating the charge sharing effect.
Figure 7:
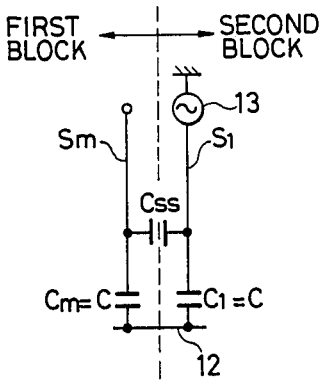
FIG. 7 is an equivalent circuit during time-division driving.
Figure 6:
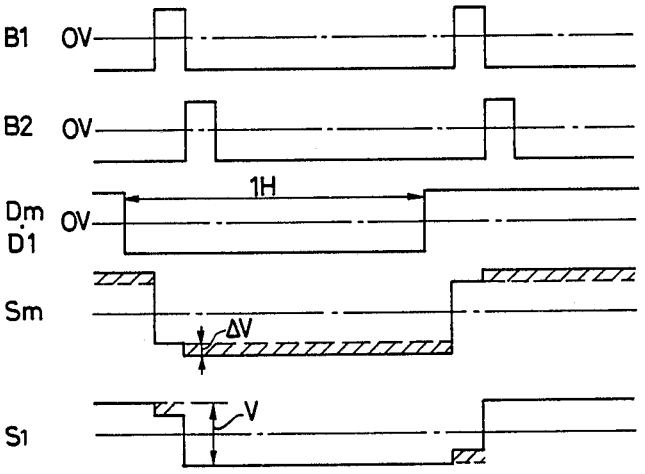
FIG. 6 is a timing chart showing the operation of the equivalent circuit.

The charge sharing effect occurs during the time from when a pulse is applied to turn on the B-TFT's of one block and to when another pulse is applied to turn on the B-TFT's of the next block. In FIG. 5, during turning-off of the B-TFT at line Bl, line Sm keeps a potential charged in the capacitor Cm and maintains an open state relative to the signal source such as the source line driver of FIG. 3. When a signal is applied during this open state to the B-TFT's of the next block 2 to turn them, line Sl is enabled to receive the signal from the signal source so that the capacitor Cl is charged. Simultaneously, the signal on line Sl charges the capacitor Css and its charge is transferred to and stored in the capacitor Cm. As a result, the waveform of line Sm changes by $\Delta V$ as shown in FIG. 6. FIG. 7 is an equivalent circuit wherein line Sm maintains an open state and the signal source 13 is coupled to line Sl.

In order to eliminate or decrease $\Delta V$, it can be considered that isolation from the signal source and connection to the signal source should not be conducted simultaneously between the lines of adjacent blocks and that Css and V be made small. Since Css is determined from the panel configuration, the remaining factors to solve the problem of $\Delta V$ are switching timings and the value V.

Paying attention to the switching timings, the present invention enables one to make a potential difference between signals on Sm and Sl very small. Particularly, the B-TFT arra of switching elements of each block is further divided into two half-blocks. A switching signal line is provided for each of the half-blocks, the phase of a control signal applied to the switching elements for each of the half-blocks is shifted between adjacent half-blocks to output video signals onto the internal video signal lines at superposed timings.

The embodiment of the present invention will now be described in detail with reference to the accompanying drawings.

Figure 1:
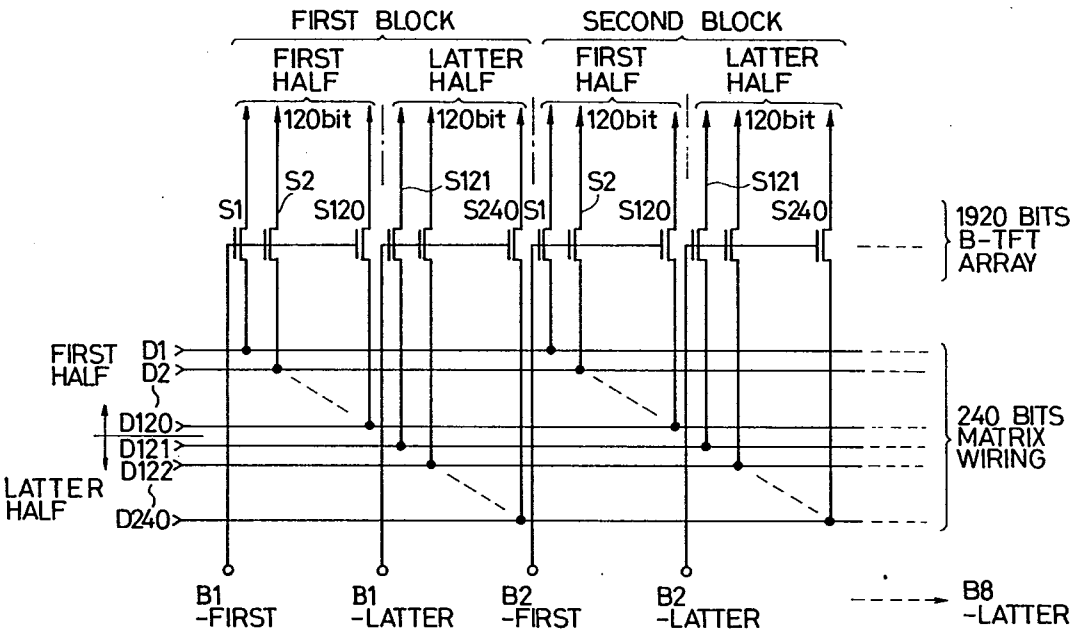
FIG. 1 is a connection diagram showing the main part of the liquid crystal device according to an embodiment of the present invention.
Figure 3:
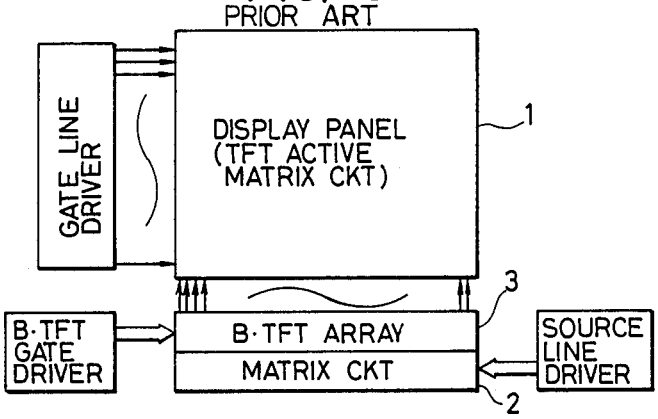
FIG. 3 PRIOR ART
FIG. 3 is a schematic block diagram showing the liquid crystal device according to the prior art.
Figure 4:
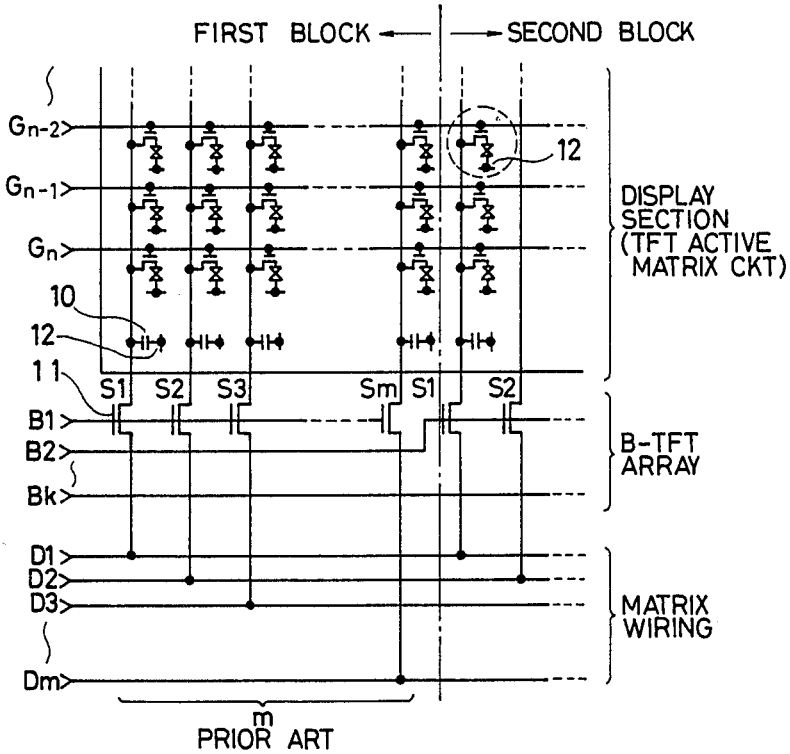
FIG. 4 is a timing chart showing the operation of the device of FIG. 3.

FIG. 1 is a connection diagram showing the B-TFT's and matrix circuit embodying the present invention. In this embodiment, the same display panel as the conventional one shown in FIG. 3 is used. A TFT active matrix circuit constituting a display portion, B-TFT array and matrix circuit are fabricated on a single substrate. In FIG. 1, the total number of matrix wirings is 240 which are here identified as first half 120 wirings and latter half 120 wirings. Video signal lines of one block, i.e., panel source lines are connected to 240 bit B-TFT's. The panel source lines and B-TFT's are similarly identified as first half 120 ones and latter half ones.

A control signal line for turning on and off the B-TFT's of the first 120 bits of block 1 is identified as "Bl-first", while a control signal line for turning on and off the B-TFT's of the latter 120 bits of block 1 as "Bl-latter". Similar identification is made up to "B8-latter". Thus, the total number of panel source lines is $8\times240$. The number of gate lines (scanning lines) is 480 and the panel corresponds to a TV screen of about 7 inches.

Figure 2:
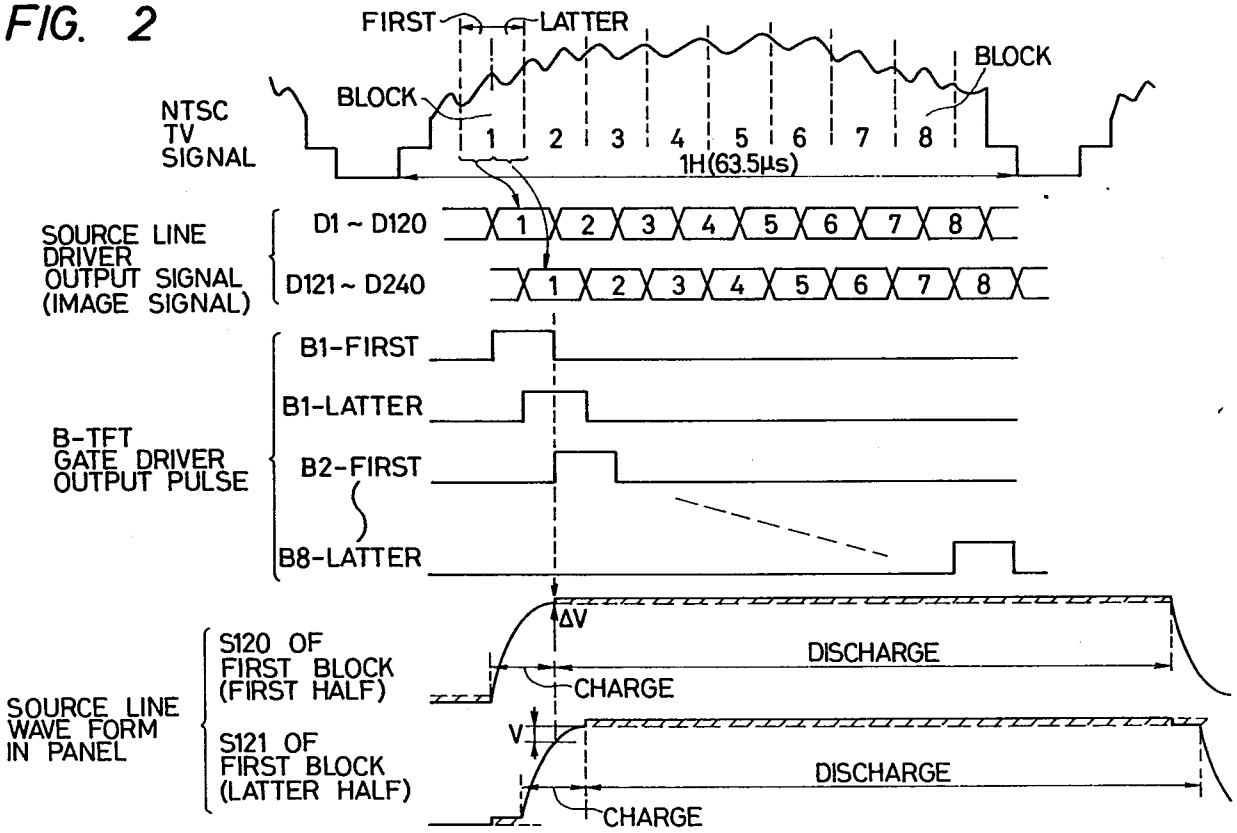
FIG. 2 is a timing chart showing the operation of the device of FIG. 1.

FIG. 2 is a timing chart showing the operation of the liquid crystal device of FIG. 1 wherein an NTSC television signal is used as a video signal source. The television video signal is divided into eight portions which are assigned to blocks 1 to 8 as a video signal source of the display panel, each of the blocks being divided into the first half and the latter half. In the present invention, the divided video signal is processed by controlling the output timings of the source line driver as in the following.

When image data of the first 120 bits of block 1 is inputted, this data is outputted on source lines Dl to Dl20. Simultaneously therewith, a pulse for turning on the B-TFT's of the first 120 bits is applied to control line "Bl-first" to charge the first 120 source lines of block 1. Next, when image data of the latter 120 bits of block 1 is prepared, this data is outputted on source lines Dl2l to D240. Simultaneously therewith, a pulse for turning on the B-TFT's of the latter 120 bits is applied to control line "Bl-latter" to charge the latter 120 source lines of block 1. The phase of the on/off control signals on "Bl-first" and "Bl-latter" and so on is phase shifted 90 degrees so as to be superposed between two adjacent half-blocks. Similar timings of the control signals are repeated up to block 8 to write a lH television signal on 1920 source lines. In this case, the liquid crystal (TN liquid crystal, ferroelectric liquid crystal) is ac-driven by grounding the opposing electrode or by reversing every lH in synchro with the television signal.

In the above liquid crystal drive, the source line waveforms in the panel shown in FIG. 2, particularly the charge/discharge waveforms of the source lines Sl20 and Sl2l at the intersection of blocks, are observed. The potential difference V on the source line Sl2l is very small at the time when a pulse on "Bl-first" for the source line Sl20 of block 1 turns off. This V corresponds to the V of the above-described approximate formula. Therefore, $\Delta V$ in the formula becomes considerably small. The potential difference $\Delta V$ at the leading edge of the source line waveform shown in FIG. 2 becomes extremely small.

One block of the above embodiment may be divided into three or more.

As seen from the foregoing description of the present invention,eeven if the charge sharing effect occurs during lH reversal drive, the resultant potential difference can be reduced to a minimum by driving the finely divided blocks at superposed timings. Further, in case the charge speed with a B-TFT is high, the potential difference can theoretically be made zero. Thus, it is possible to eliminate high intensity lines at the intersection of blocks and provide a liquid crystal device and method of driving the same capable of obtaining a high image quality.

We claim:

1. In a driving method for a video display, comprising the steps of:

dividing internal video signal lines of a TFT active matrix panel into a plurality of blocks;

providing a matrix circuit for matrix-connection between the internal video signal lines of each block and external video signal lines having the same number of lines as the former lines;

interposing sample/hold switching elements on the respective internal video lines between the matrix circuit and the panel;

supplying control signals to the switching elements of each block to drive the panel in time division using one horizontal period as a reversal period;

dividing switching elements of each block into two half-blocks;

providing a switching signal line for each of said half-blocks; and shifting the phase of a control signal applied to said switching elements for each of said half-blocks, wherein the external video signal lines are divided into two groups, the video signals supplied to one group of the external video signal lines being shifted by one-half phase compared with the video signals supplied to the other group of the external video signal lines, and in synchronization with the phase shifting operation, the two control signals applied to said adjacent two half-blocks being shifted by one-half phase from each other.

2. In a method of driving a liquid crystal device comprising the steps of:

dividing internal video signal lines of a TFT active matrix panel into a plurality of blocks;

providing a matrix circuit for matrix-connection between the internal video signal lines of each block and external video signal lines having the same number of lines as the former lines;

interposing sample/hold switching elements on the respective internal video lines between the matrix circuit and the panel;

supplying control signals to the switching elements of each block to drive the panel in time division using one horizontal period as a reversal period;

dividing said switching elements of each block divided into two half-blocks;

providing a switching signal line for each of said half-blocks; and shifting the phase of a control signal applied to said switching elements for each of said half-blocks between adjacent half-blocks wherein the external video signal lines are divided into two groups, the video signals supplied to one group of the external video signal lines being shifted by one-half phase compared with the video signals supplied to the other group of the external video signal lines, and in sychronization with the phase shifting operation, the two control signals applied to said adjacent two half-blocks being shifted by one-half phase from each other.

3. A driving method according to claim 2, wherein said liquid crystal device is a TN liquid crystal device.

4. A driving method according to claim 2, wherein said liquid crystal device is a ferroelectric liquid crystal device.

5. A display device comprising:

a display panel wherein internal video signal lines of a TFT active matrix panel are divided into a plurality of blocks, a matrix circuit is provided for matrix-connection between the internal video signal lines of each block and external video signal lines having the same number of lines as the former lines, sample/hold switching elements are interposed on the respective internal video lines between the matrix circuit and the panel, and control signals are supplied to the switching elements of each block to drive the panel in time division using one horizontal period as a reversal period; and output means wherein said switching elements of each block are further divided into two half blocks, a switching signal line is provided for each of said half-blocks, the phase of a control signal applied to said switching elements for each of said half-blocks is shifted between adjacent half-blocks wherein the external video signal lines are divided into two groups, the video signals supplied to one group of the external video signal lines being shifted by one-half phase compared with the video signals supplied to the other group of the external video signal lines, and in synchronization with the phase shifting operation, the two control signals applied to said adjcent two half-blocks being shifted by one-half phase from each other.

6. A display device comprising:

a liquid crystal device wherein internal video signal lines of a TFT active matrix panel are divided into a plurality of blocks, a matrix circuit is provided for matrix-connection between the internal video signal lines of each block and external video signal lines having the same number of lines as the former lines, sample/hold switching elements are interposed on the respective internal video lines between the matrix circuit and the panel, and control signals are supplied to the switching elements of each block to drive the panel in time division using one horizontal period as a reversal period; and out means wherein said switching elements of each block are further divided into two half-blocks, switching signal line is provided for each of said half-blocks, the phase of a control signal applied to said switching elements for each of said half-blocks is shifted between adjacent half-blocks wherein the external video signal lines are divided into two groups, the video signals supplied to one group of the external video signal lines being shifted by one half phase compared with the video signals supplied to the other group of the external video signal lines, and in synchronization with the phase shifting operation, the two control signals applied to said adjacent two half-blocks being shifted by one-half phase from each other.

7. A liquid crystal device according to claim 6, wherein said liquid crystal is a TN liquid crystal.

8. A liquid crystal device according to claim 6, wherein said liquid crystal is a ferroelectric liquid crystal.

* * * * *

UNITED STATES PATENT AND TRADEMARK OFFICE

CERTIFICATE OF CORRECTION

PATENT NO. : 4,779,086

DATED : October 18, 1988

INVENTOR(S) : HIDEO KANNO, ET AL.

It is certified that error appears in the above-identified patent and that said Letters Patent is hereby corrected as shown below:

COLUMN 1

Line 61, "source line capacitance Cm and Cl" should read --source line capacitors Cm and Cl--.

COLUMN 2

Line 36, "line" should read --lines--.
Line 38, "(respective" should read --respective--.

COLUMN 3

Line 32, "arra" should read --array--.
Line 53, "latter half ones." should read --latter half 120 ones.--.

COLUMN 4

Line 38, "invention,eeven" should read --invention, even--.

UNITED STATES PATENT AND TRADEMARK OFFICE

CERTIFICATE OF CORRECTION

PATENT NO. : 4,779,086

DATED : October 18, 1988

INVENTOR(S) : HIDEO KANNO, ET AL.

It is certified that error appears in the above-identified patent and that said Letters Patent is hereby corrected as shown below:

COLUMN 6

Line 6, "half blocks," should read --half-blocks,--.
Line 10, "half-blocks" should read --half-blocks,--.
Line 18, "adjcent" should read --adjacent--.
Line 32, "and out" should read --and ¶ output--.
Line 35, "switching" should read --a switching--.
Line 38, "half-blocks" should read --half-blocks,--.
Line 42, "one half" should read --one-half--.
Line 48, "liquid crystal" should read --display--.
Line 50, "liquid crystal" should read --display--.

Signed and Sealed this

Third Day of April, 1990

*Attest:*

HARRY F. MANBECK, JR.

*Attesting Officer*

*Commissioner of Patents and Trademarks*